US010301927B2

(12) United States Patent
Sallwasser

(10) Patent No.: US 10,301,927 B2
(45) Date of Patent: May 28, 2019

(54) METAL SEALING DEVICE

(71) Applicant: Schlumberger Technology Corporation, Sugar Land, TX (US)

(72) Inventor: Alan Sallwasser, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 80 days.

(21) Appl. No.: 15/153,085

(22) Filed: May 12, 2016

(65) Prior Publication Data

US 2016/0333661 A1 Nov. 17, 2016

Related U.S. Application Data

(60) Provisional application No. 62/162,440, filed on May 15, 2015.

(51) Int. Cl.
*E21B 34/14* (2006.01)
*E21B 47/09* (2012.01)

(52) U.S. Cl.
CPC ..... *E21B 47/0905* (2013.01); *E21B 34/14* (2013.01)

(58) Field of Classification Search
CPC ..... E21B 23/08; E21B 23/10; E21B 34/14; E21B 47/0905
See application file for complete search history.

(56) References Cited

U.S. PATENT DOCUMENTS

| | | | | |
|---|---|---|---|---|
| 4,901,794 | A | 2/1990 | Baugh et al. | |
| 7,775,279 | B2 | 8/2010 | Marya et al. | |
| 8,211,247 | B2 | 7/2012 | Marya et al. | |
| 8,276,674 | B2 | 10/2012 | Lopez de Cardenas et al. | |
| 2012/0085538 | A1 | 4/2012 | Guerrero et al. | |
| 2013/0062063 | A1 | 3/2013 | Baihly et al. | |
| 2014/0014371 | A1* | 1/2014 | Jacob | E21B 33/129 166/382 |
| 2014/0076542 | A1* | 3/2014 | Whitsitt | E21B 34/14 166/250.1 |
| 2014/0158350 | A1* | 6/2014 | Castillo | E21B 23/10 166/250.17 |
| 2015/0060064 | A1 | 3/2015 | Lafferty et al. | |
| 2015/0247375 | A1 | 9/2015 | Stout | |

FOREIGN PATENT DOCUMENTS

| | | |
|---|---|---|
| WO | WO2002097234 | 12/2002 |

OTHER PUBLICATIONS

Exam Report of Australian Patent Application No. 2016203152 dated Aug. 18, 2016, 7 pages.

* cited by examiner

*Primary Examiner* — Brad Harcourt

(57) ABSTRACT

A technique includes deploying an untethered object through a passageway of a string in a well to cause the untethered object to travel along the passageway. The technique includes operating the untethered object as the object travels in the passageway to expand a metal sealing device of the untethered object to cause the object to become caught at a downhole location.

14 Claims, 7 Drawing Sheets

METAL SEALING DEVICE

CROSS-REFERENCE TO RELATED APPLICATIONS

This application claims benefit of U.S. Provisional Patent Application Ser. No. 62/162,440, filed May 15, 2015, which is herein incorporated by reference.

BACKGROUND

For purposes of preparing a well for the production of oil or gas, at least one perforating gun may be deployed into the well via a conveyance mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools. A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

Embodiments may take the form of a method including deploying an untethered object through a passageway of a string in a well to cause the untethered object to travel along the passageway, and operating the untethered object as the object travels in the passageway to expand a metal sealing device of the untethered object to cause the object to become caught at a downhole location.

Other embodiments may take the form of a system usable with a well having: a string with a passageway, and an untethered object adapted to be deployed in the passageway such that the object travels in the passageway. The object includes a metal sealing device, an actuator, and a controller to operate the actuator to selectively radially expand the metal seal as the untethered object travels in the passageway.

Further other embodiments may take the form of an apparatus having a metal seal. The metal seal includes a first pressure receiving side to circumscribe an axis of the seal, a second pressure receiving side to circumscribe the axis, first axially-extending slots in the first pressure receiving side, second axially-extending slots in the second pressure receiving side, and an expansion member to extend inside the metal seal to transition the metal seal downhole in the well from a first outer diameter to a larger second outer diameter. The second axially-extending slots are offset from the first axially-extending slots to form axially-extending beams.

Advantages and other features will become apparent from the following drawings, description and claims.

DETAILED DESCRIPTION

Figure 1:
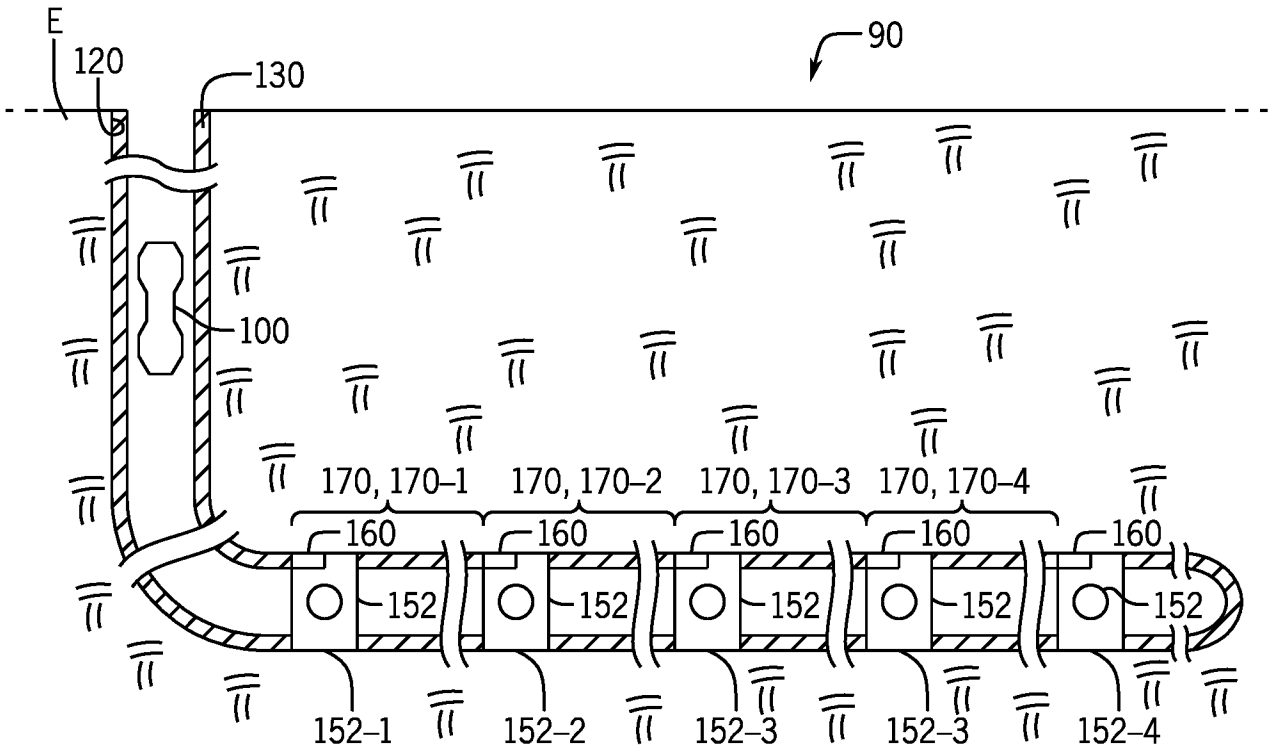
FIG. 1 is a schematic diagram of a well according to an example implementation.

In general, systems and techniques are disclosed herein for purposes of deploying an untethered object into a well, and selectively expanding a metal sealing device of the untethered object for purposes of performing a downhole operation. In this context, an "untethered object" refers to an object that travels at least some distance in a well passageway without being attached to a conveyance mechanism (a slickline, wireline, coiled tubing string, and so forth). As specific examples, the untethered object may be a dart, a ball or a bar. However, the untethered object may take on different forms, in accordance with further implementations. In accordance with some implementations, the untethered object may be pumped into the well (i.e., pushed into the well with fluid), although pumping may not be employed to move the object in the well, in accordance with further implementations.

In general, the untethered object may be used to perform a downhole operation that may or may not involve actuation of a downhole tool As just a few examples, the downhole operation may be a stimulation operation (a fracturing operation or an acidizing operation as examples); an operation performed by a downhole tool (the operation of a downhole valve, the operation of a single shot tool, or the operation of a perforating gun, as examples); the formation of a downhole obstruction; or the diversion of fluid (the diversion of fracturing fluid into a surrounding formation, for example). Moreover, in accordance with example implementations, a single untethered object may be used to perform multiple downhole operations in multiple zones, or stages, of the well, as further disclosed herein.

In accordance with example implementations, the untethered object is deployed in a passageway (a tubing string passageway, for example) of the well, travels to a targeted position of the well and then radially expands its metal seal to initiate a downhole operation. In this manner, the untethered object is initially radially contracted when the object is deployed into the passageway. The object travels through the passageway in its radially contracted state until reaching a predetermined location at which the metal seal of the object radially expands. The increased cross-section of the object due to radial expansion of the metal seal may be used to effect any of a number of downhole operations, such as shifting a valve, forming a fluid obstruction, actuating a tool, and so forth. Moreover, because the object remains radially contracted before reaching the predetermined location, the object may pass through downhole restrictions (valve seats, for example) that may otherwise "catch" the object, thereby allowing the object to be used in, for example, multiple stage applications in which the object is used in conjunction with seats of the same size so that the object selects which seat catches the object.

In accordance with example implementations, the untethered object may be controlled in response to markers that are installed along a tubular string through which the object passes. In this regard, the untethered object may pass through a number of seats (for example), and when the untethered object senses a marker in proximity to a targeted seat, the untethered object radially expands as a metal seal for purposes of causing the object to be caught by the targeted seat. As an example, the marker may be a radio frequency identification (RFID) tag.

In general, the untethered object is constructed to sense its downhole position as it travels in the well and autonomously respond based on this sensing. As disclosed herein, the untethered object may sense its position based on features of the string, markers, formation characteristics, sensed chemicals, mechanical contact with features of the surrounding string, and so forth, depending on the particular implementation. As a more specific example, for purposes of sensing its downhole location, the untethered object may be constructed to, during its travel, sense specific points in the well, called "markers" herein. Moreover, as disclosed herein, the untethered object may be constructed to detect the markers by sensing a property of the environment surrounding the object (a physical property of the string or formation, as examples). The markers may be dedicated tags or materials installed in the well for location sensing by the object or may be formed from features (sleeve valves, casing valves, casing collars, and so forth) of the well, which are primarily associated with downhole functions, other than location sensing. Moreover, as disclosed herein, in accordance with example implementations, the untethered object may be constructed to sense its location in other and/or different ways that do not involve sensing a physical property of its environment, such as, for example, sensing a pressure for purposes of identifying valves or other downhole features that the object traverses during its travel.

In general, the untethered object may, in accordance with example implementations, initiate its radially expansion to cause the object to be caught at a downhole location in accordance with any of the ways described in U.S. Pat. No. 8,276,674, entitled, "DEPLOYING AN UNTETHERED OBJECT IN A PASSAGEWAY OF A WELL," which granted on Oct. 2, 2012, is hereby incorporated by reference; and U.S. Patent Application Publication No. US 2014/0076542, entitled, "AUTONOMOUS UNTETHERED WELL OBJECT," which published on Mar. 20, 2014 and is also hereby incorporated by reference in its entirety.

Referring to FIG. 1, as a more specific example, in accordance with some implementations, a multiple stage well 90 includes a wellbore 120, which traverses one or more formations (hydrocarbon bearing formations, for example). As a more specific example, the wellbore 120 may be lined, or supported, by a tubing string 130, as depicted in FIG. 1. The tubing string 130 may be cemented to the wellbore 120 (such wellbores typically are referred to as "cased hole" wellbores); or the tubing string 130 may be secured to the formation by packers (such wellbores typically are referred to as "open hole" wellbores). In general, the wellbore 120 extends through one or multiple zones, or stages 170 (four stages 170-1, 170-2, 170-3 and 170-4, being depicted as examples in FIG. 1) of the well 90.

It is noted that although FIG. 1 depicts a laterally extending wellbore 120, the systems and techniques that are disclosed herein may likewise be applied to vertical wellbores. In accordance with example implementations, the well 90 may contain multiple wellbores, which contain tubing strings that are similar to the illustrated tubing string 130. Moreover, depending on the particular implementation, the well 90 may be an injection well or a production well. Thus, many variations are contemplated, which are within the scope of the appended claims.

In general, the downhole operations may be multiple stage operations that may be sequentially performed in the stages 170 in a particular direction (in a direction from the toe end of the wellbore 120 to the heel end of the wellbore 120, for example) or may be performed in no particular direction or sequence, depending on the implementation.

Although not depicted in FIG. 1, fluid communication with the surrounding reservoir may be enhanced in one or more of the stages 170 through, for example, abrasive jetting operations, perforating operations, and so forth.

In accordance with example implementations, the well 90 of FIG. 1 includes downhole tools 152 (tools 152-1, 152-2, 152-3 and 152-4, being depicted in FIG. 1 as examples) that are located in the respective stages 170. The tool 152 may be any of a variety of downhole tools, such as a valve (a circulation valve, a casing valve, a sleeve valve, and so forth), a seat assembly, a check valve, a plug assembly, and so forth, depending on the particular implementation. Moreover, the tool 152 may be different tools (a mixture of casing valves, plug assemblies, check valves, and so forth, for example). As depicted in FIG. 1, the tools 152 may be part of the tubing string 130.

It is noted that the well 90 may have more or fewer than four stages 170, and the well 90 may have more or fewer or than four downhole tools 152, depending on the particular implementation. Moreover, multiple downhole tools 152 may be disposed in a given stage 170, in accordance with example implementations.

In accordance with example implementations, a given tool 152 may be selectively actuated by deploying an untethered object through the central passageway of the tubing string 130. In general, the untethered object has a radially contracted state to permit the object to pass relatively freely through the central passageway of the tubing string 130 (and thus, through tools of the string 130), and the object has a radially expanded state, which causes the object to land in, or, be "caught" by, a selected one of the tools 152 or otherwise secured at a selected downhole location, in general, for purposes of performing a given downhole operation. For example, a given downhole tool 152 may catch the untethered object for purposes of forming a downhole obstruction to divert fluid (divert fluid in a fracturing or other stimulation operation, for example); pressurize a given stage 170; shift a sleeve of the tool 152; actuate the tool 152; install a check valve (part of the object) in the tool 152; and so forth, depending on the particular implementation.

For the specific example of FIG. 1, the untethered object is a dart 100, which, as depicted in FIG. 1, may be deployed (as an example) from the Earth surface E into the tubing string 130 and propagate along the central passageway of the string 130 until the dart 100 senses proximity of the targeted tool 152 (as further disclosed herein), radially expands and engages the tool 152. It is noted that the dart 100 may be deployed from a location other than the Earth surface E, in accordance with further implementations. For example, the dart 100 may be released by a downhole tool. As another example, the dart 100 may be run downhole on a conveyance mechanism and then released downhole to travel further downhole untethered.

In accordance with an example implementation, the tools 152 may be sleeve valves that may be initially closed when run into the well 90 but subsequently shifted open when engaged by the dart 100 for purposes for performing fracturing operations from the heel to the toe of the wellbore 120 (for the example stages 170-1, 170-2, 170-3 and 170-4 depicted in FIG. 1). In this manner, for this example, before being deployed into the wellbore 120, the dart 100 may be configured, or programmed, to sequentially target the tools 152 of the stages 170-1, 170-2, 170-3 and 170-4 in the order in which the dart 100 encounters the tools 152.

Continuing the example, the dart 100 is released into the central passageway of the tubing string 130 from the Earth surface E, travels downhole in the tubing string 130, and when the dart 100 senses proximity of the tool 152 of the stage 170-1 along the dart's path, the dart 100 radially expands to engage a dart catching seat of the tool 152. Using the resulting fluid barrier, or obstruction, that is created by the dart 100 landing in the tool 152, fluid pressure may be applied uphole of the dart 100 (by pumping fluid into the tubing string 130, for example) for purposes of creating a force to shift the sleeve of the tool 152 (a sleeve valve, for this example) to open radial fracture ports of the tool 152 with the surrounding formation in the stage 170-1.

In accordance with example implementations, the dart 100 may be constructed to subsequently radially contract to release itself from the tool 152 (as further disclosed herein) of the stage 170-1, travel further downhole through the tubing string 130, radially expand in response to sensing proximity of the tool 152 of the stage 170-2, and land in the tool of the stage 170-2 to create another fluid obstruction. Using this fluid obstruction, the portion of the tubing string 130 uphole of the dart 100 may be pressurized for purposes of fracturing the stage 170-1 and shifting the sleeve valve of the stage 170-2 open. Thus, the above-described process repeats in the heel-to-toe fracturing, in accordance with an example implementation, as the fracturing proceeds downhole until the stage 170-4 is fractured. It is noted that although FIG. 1 depicts four stages 170-1, 170-2, 170-3 and 170-4, the heel-to-toe fracturing may be performed in fewer or more than four stages, in accordance with further implementations.

In accordance with further example implementations, the dart 100 may not be constructed to radially contract after the dart 100 radially expands and becomes lands in a given downhole tool. For these example implementations, the dart 100 may be removed through a milling operation or the dart 100 may be constructed from one or more degradable materials (as further described below), which effects a timed release of the dart to eventually clear the passageway of the tubing string 130 to allow another dart 100 (targeting another tool) to be deployed downhole or any other operation to be performed, which relies on the passageway being cleared.

Although examples are disclosed herein in which the dart 100 is constructed to radially expand at the appropriate time so that a tool 152 of the string 130 catches the dart 100, in accordance with other implementations disclosed herein, the dart 100 may be constructed to secure itself to an arbitrary position of the string 130, which is not part of a tool 152. Thus, many variations are contemplated, which are within the scope of the appended claims.

For the example that is depicted in FIG. 1, the dart 100 is deployed in the tubing string 130 from the Earth surface E for purposes of engaging one of the tools 152 (i.e., for purposes of engaging a "targeted tool 152"). In accordance with example implementations, the dart 100 autonomously senses its downhole position, remains radially contracted to pass through tool(s) 152 (if any) uphole of the targeted tool 152, and radially expands before reaching the targeted tool 152. In accordance with some implementations, the dart 100 senses its downhole position by sensing the presence of markers 160 which may be distributed along the tubing string 130.

For the specific example of FIG. 1, each stage 170 contains a marker 160, and each marker 160 is embedded in a different tool 152. The marker 160 may be a specific material, a specific downhole feature, a specific physical property, a radio frequency (RF) identification (RFID), tag, and so forth, depending on the particular implementation.

It is noted that each stage 170 may contain multiple markers 160; a given stage 170 may not contain any markers 160; the markers 160 may be deployed along the tubing string 130 at positions that do not coincide with given tools 152; the markers 160 may not be evenly/regularly distributed as depicted in FIG. 1; and so forth, depending on the particular implementation. Moreover, although FIG. 1 depicts the markers 160 as being deployed in the tools 152, the markers 160 may be deployed at defined distances with respect to the tools 152, depending on the particular implementation. For example, the markers 160 may be deployed between or at intermediate positions between respective tools 152, in accordance with further implementations. Thus, many variations are contemplated, which are within the scope of the appended claims.

In accordance with an example implementation, a given marker 160 may be a magnetic material-based marker, which may be formed, for example, by a ferromagnetic material that is embedded in or attached to the tubing string 130, embedded in or attached to a given tool housing, and so forth. By sensing the markers 160, the dart 100 may determine its downhole position and selectively radially expand accordingly. As further disclosed herein, in accordance with an example implementation, the dart 100 may maintain a count of detected markers. In this manner, the dart 100 may sense and log when the dart 100 passes a marker 160 such that the dart 100 may determine its downhole position based on the marker count.

Thus, the dart 100 may increment (as an example) a marker counter (an electronics-based counter, for example) as the dart 100 traverses the markers 160 in its travel through the tubing string 130; and when the dart 100 determines that a given number of markers 160 have been detected (via a threshold count that is programmed into the dart 100, for example), the dart 100 radially expands.

For example, the dart 100 may be launched into the well 90 for purposes of being caught in the tool 152-3. Therefore, given the example arrangement of FIG. 1, the dart 100 may be programmed at the Earth surface E to count two markers 160 (i.e., the markers 160 of the tools 152-1 and 152-2) before radially expanding. The dart 100 passes through the tools 152-1 and 152-2 in its radially contracted state; increments its marker counter twice due to the detection of the markers 152-1 and 152-2; and in response to its marker counter indicating a "2," the dart 100 radially expands so that the dart 100 has a cross-sectional size that causes the dart 100 to be "caught" by the tool 152-3.

Figure 2A:
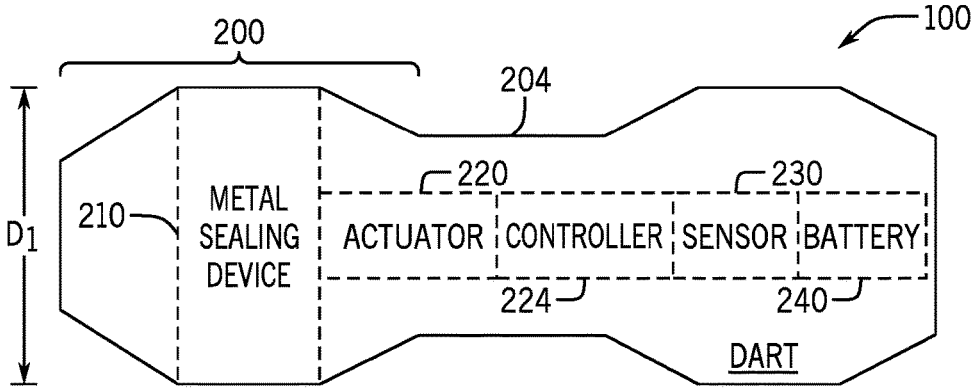
FIG. 2A is a schematic diagram of a dart in a radially contracted state according to an example implementation.
Figure 2B:
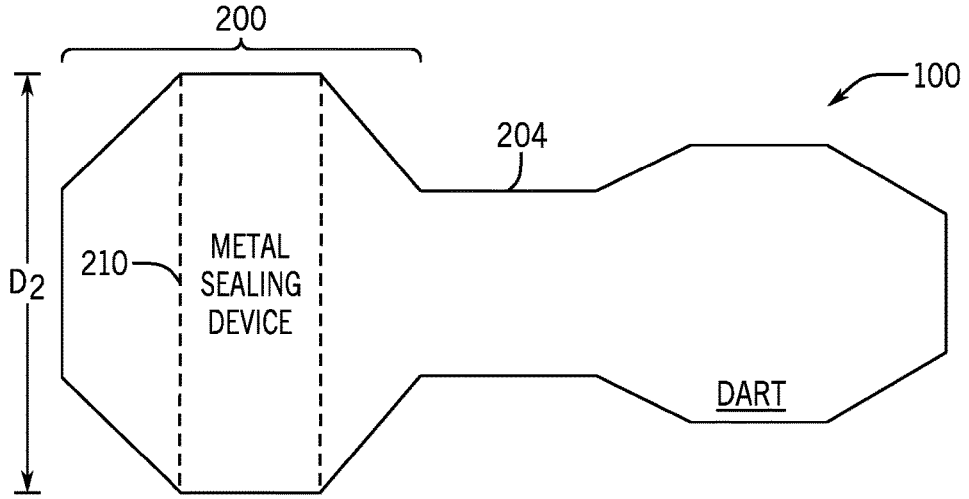
FIG. 2B is a schematic diagram of the dart in a radially expanded state according to an example implementation.

Referring to FIG. 2A, in accordance with an example implementation, the dart 100 includes a body 204 having a section 200, whose cross-sectional dimension D1 is controlled by a slotted metal sealing device 210, which may surround the periphery of the body 204. The dart 100 is constructed to radially expand the metal sealing device 210 to a radially larger cross-sectional diameter D2 (as depicted in FIG. 2B) for purposes of causing the dart 100 to become lodged at a targeted downhole location (a seat, a tool or a tubing location, for example).

As depicted in FIG. 2A, in accordance with an example implementations, the dart 100 may includes a controller 224 (a microcontroller, microprocessor, field programmable gate array (FPGA), or central processing unit (CPU), as examples), which receives either commands from the surface or feedback as to the dart's position and generates the appropriate signal(s) to activate an actuator 220 at the appropriate time to cause radial expansion of the metal sealing device 210.

As depicted in FIG. 2A, among its other components, the dart 100 may have a stored energy source, such as a battery 240; a sensor 230 to sense one or more downhole parameters; and an interface (a wireless interface, for example), which is not shown in FIG. 2A, for purposes of programming the dart 100 with one or more parameters (a threshold marker count or other information to inform the controller 224 when to radially expand the metal sealing device 210, for example) before the dart 100 is deployed in the well 90.

Figure 3:
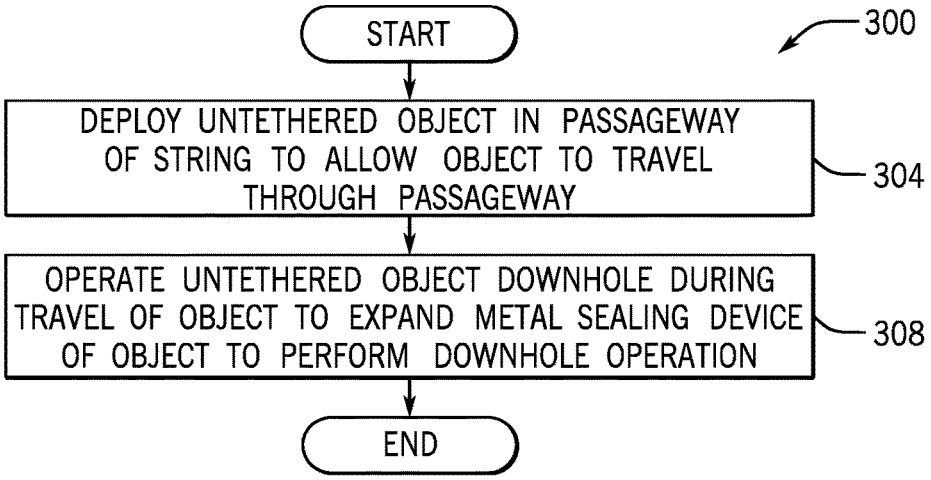
FIG. 3 is a flow diagram depicting a technique to use a metal sealing device to perform a downhole operation according to an example implementation.

Thus, referring to FIG. 3, a technique 300 in accordance with example implementations includes deploying (block 304) an untethered object in a passageway of a string to allow the object to travel through the passageway. Pursuant to the technique 300, the untethered object operated (block 308) to expand a metal sealing device of the object downhole during travel of the object to perform a downhole operation.

Figure 4A:
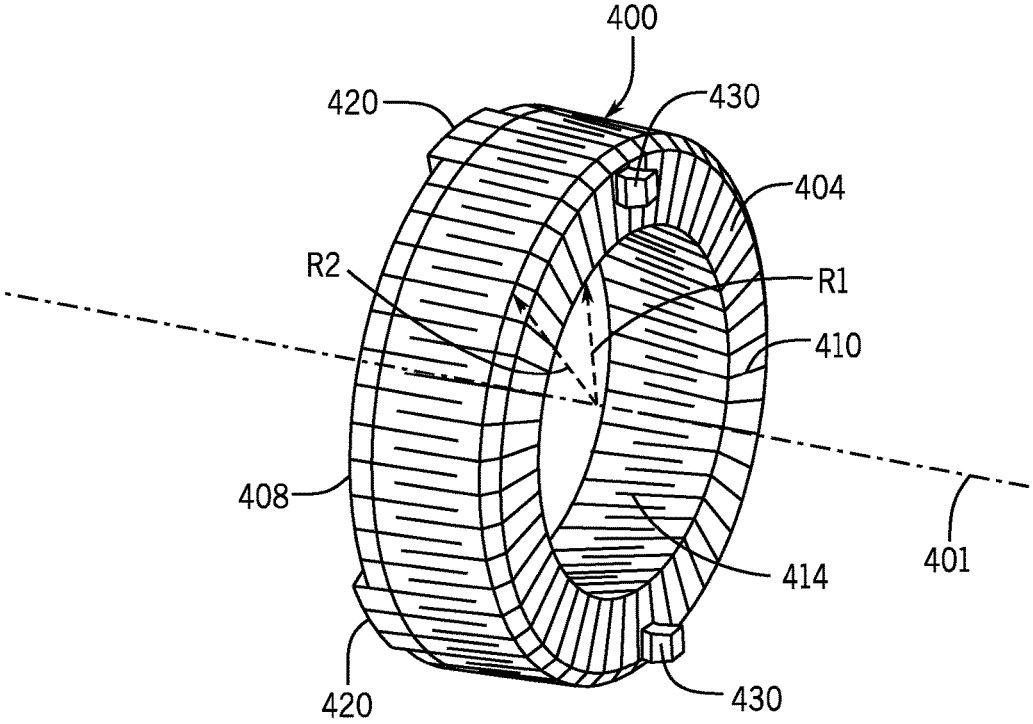
FIG. 4A is a perspective view of a metal sealing device according to an example implementation.

Referring to FIG. 4A, in accordance with example implementations, an untethered object, such as a dart, may include a metal sealing device 400 for purposes of forming an annular seal between the exterior of the object and a downhole seat. In general, the metal sealing device 400 is an expandable slotted ring having a radially contracted position and a radially expanded position. As described herein, the metal sealing device 400 circumscribes an axis 401, and the metal sealing device 400 may be moved upon a conical expansion member by an actuator of the untethered object (such as actuator 220 (FIG. 2A), as controlled by controller 224) for purposes of controlling the expansion of the metal sealing device 400.

The outer diameter of the metal sealing device 210 establishes the outer diameter for the untethered object. In its radially contracted position, outer diameter of the metal sealing device 400 is sufficiently small enough to allow the untethered object to pass through downhole seats, tools, tubing passageways, and so forth, as the object travels downhole. In its radially expanded position, outer diameter of the metal sealing device 400 is sufficiently large to cause the untethered object to become lodged, or caught, by a targeted seat, downhole tubing diameter, downhole tool or other restriction, which has an appropriately sized inner diameter.

More specifically, in accordance with example implementations, the metal sealing device 400 is constructed to expand to its radially expanded state for purposes of causing the untethered object to be received, or caught, by a targeted downhole seat. When caught by the seat, the metal sealing device 400 forms an annular fluid seal between the outside surface of the untethered object's body and the seat, so that a corresponding fluid barrier, or obstruction, is formed. As depicted in FIG. 4A, the metal sealing device 400 forms a ring about the longitudinal axis 401 and extends from an inner radius R1 to an outer radius R2. The R1 and R2 radii slightly expand, as the metal sealing device 400 transitions between from its radially contracted state to its radially expanded state, in accordance with example implementations.

In accordance with example implementations, the ability of the metal sealing device 400 to form a fluid seal (an absolute seal or a seal that at least is associated with a sufficiently small leakage flow to allow sufficient pressurization of the string above the untethered object, for example) is due to one or more of the following characteristics. First, the area of communication between a relatively high pressure side 408 and a relatively low pressure side 404 of the metal sealing device 400 is small, such as less than one percent of the otherwise open area in the absence of the metal sealing device 400, in accordance with example implementations. Secondly, the metal sealing device 400, in accordance with example implementations, has slots on the high 408 and low 406 pressure sides that operate in a complementary fashion to deform the device 400 in a manner that enhances the fluid seal.

Figure 4B:
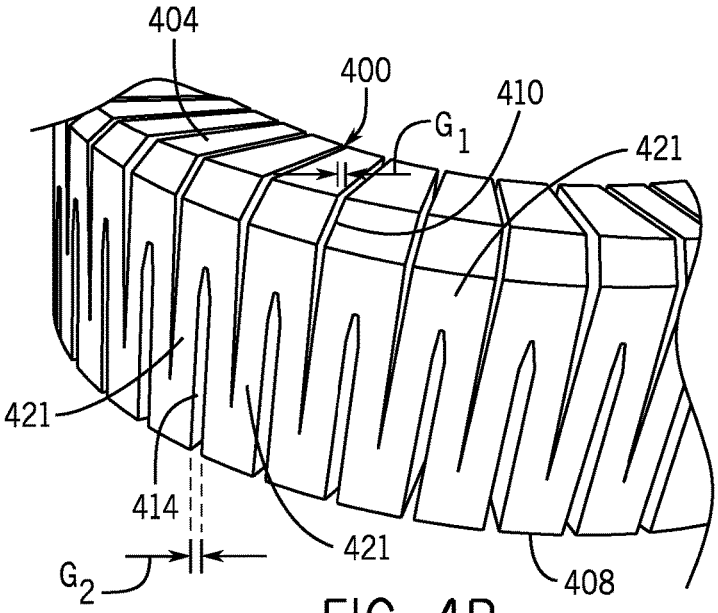
FIG. 4B is a perspective view of a section of the metal sealing device showing a more detailed view of slots of the sealing device according to an example implementation.

More specifically, referring to FIG. 4B (a more detailed view of the metal sealing device 400) in conjunction with FIG. 4A, in accordance with example implementations, the metal sealing device 400 has slots 410 on the low pressure side 404 and slots 414 on the high pressure side 408. Each slot 410 on the low pressure side 404 radially extends from the inner radius R1 to the outer radius R2 of the metal sealing device 400; and each slot 410 extends axially from the low pressure side 404 toward the high pressure side 408, stopping short of extending through the high pressure side 408. The slots 410 are distributed around the periphery of the low pressure side 404, as depicted in FIG. 4A. Each slot 414 on the high pressure side 408 radially extends from the inner radius R1 to the outer radius R2 of the metal sealing device 400; and each slot 414 extends axially from the high pressure side 408 toward the low pressure side 404, stopping short of extending through the low pressure side 404. The slots 414 are distributed around the periphery of the high pressure side 408, as depicted in FIG. 4A.

As depicted in FIGS. 4A and 4B, the slots 410 are peripherally offset with respect to the slots 414 to create corresponding axially-extending beams 421 of the metal sealing device 400. With an increasing pressure, the open area of the communication path decreases because the beams 421 have a measure of plasticity in the radial direction, allowing deformation of the metal sealing device 400 further into the communication path. Referring to FIG. 4B, the pressure force on the high pressure side 408 tends to open the slots 414 (as illustrated by gap G2), with resultant consequence of closing the slots 410 on the low pressure side 408 (as illustrated by gap G1), further blocking fluid communication.

In accordance with example implementations, each of the beams 421 remains in an elastic state during enlargement. In doing so, during the expansion process, the slots 414 on the high pressure side 408 open by substantially equal amounts.

Otherwise, there would be a preferential yielding at one of the slots 414, which may otherwise result in breaking of a beam 421; or otherwise result in a given slot 414 become too large to form a proper seal. When mated with a seat, in accordance with example implementations, the seat subtends the entirety of the metal sealing device 400, thereby blocking fluid communication between the axially-extending slots 414 on the high pressure side and the axially-extending slots 410 on the low pressure side.

In accordance with example implementations, the metal sealing device 400 may be formed from any suitable degradable metal or metal alloy. For example, the metal sealing device 400 may be formed from one or more of the following metals/metal alloys: a basic metal such as aluminum, gallium, indium, tin, thallium, and lead; an alkali metal such as magnesium, calcium and strontium. As an example, the metal sealing device may include an aluminum gallium alloy. For example, the composition may include approximately 80 percent or more by weight of aluminum or an aluminum alloy and approximately or greater than two percent of a select material or materials such as gallium, indium, tin, bismuth, and lead. As an example, a select material or materials may include one or more basic metals where, for example, basic metals include gallium, indium, tim, thallium, lead and bismuth (e.g., basic metals of atomic number 31 or greater).

Moreover, in accordance with example embodiments, the slots 410 and 414 may be formed in the metal sealing device in accordance with any suitable process. For example, the slots 410 and 414 may be formed in the metal sealing device using one or more of the following processes: mechanical processes such as drilling, cutting, grinding and so forth; laser cutting, water jet cutting; plasma cutting; and so forth. The cutting process may be precision controlled by a computer numerical controlled systems or any other suitable computer controlled system.

Figure 5A:
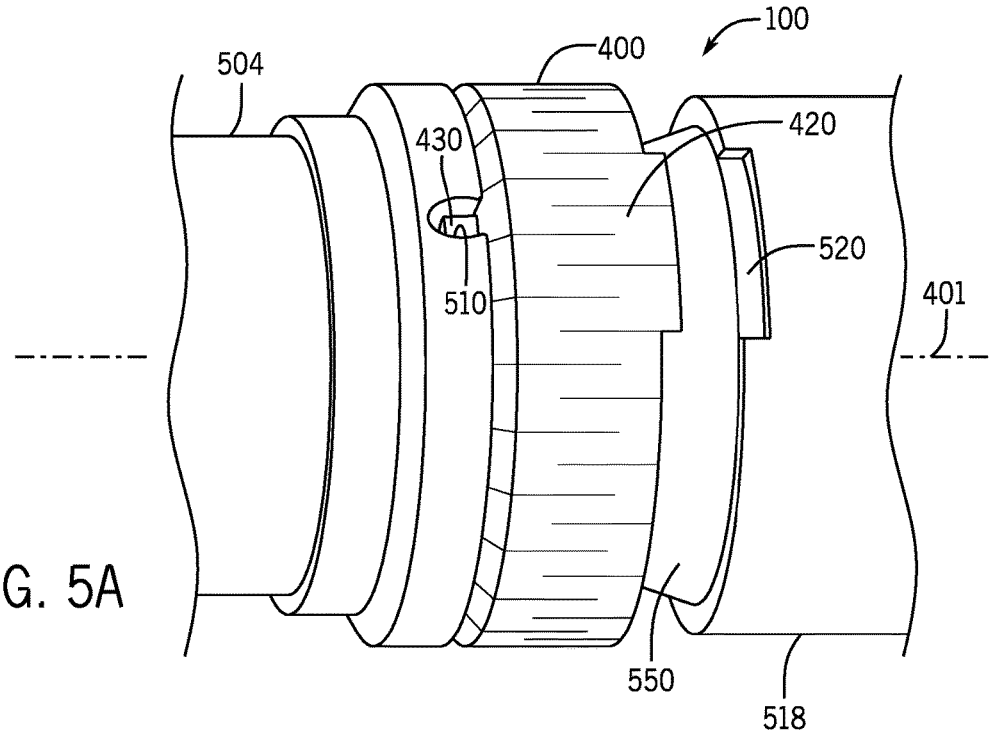
FIGS. 5A and 5B are perspective views of a dart illustrating radial expansion of a metal sealing device of the dart according to an example implementation.
Figure 5B:
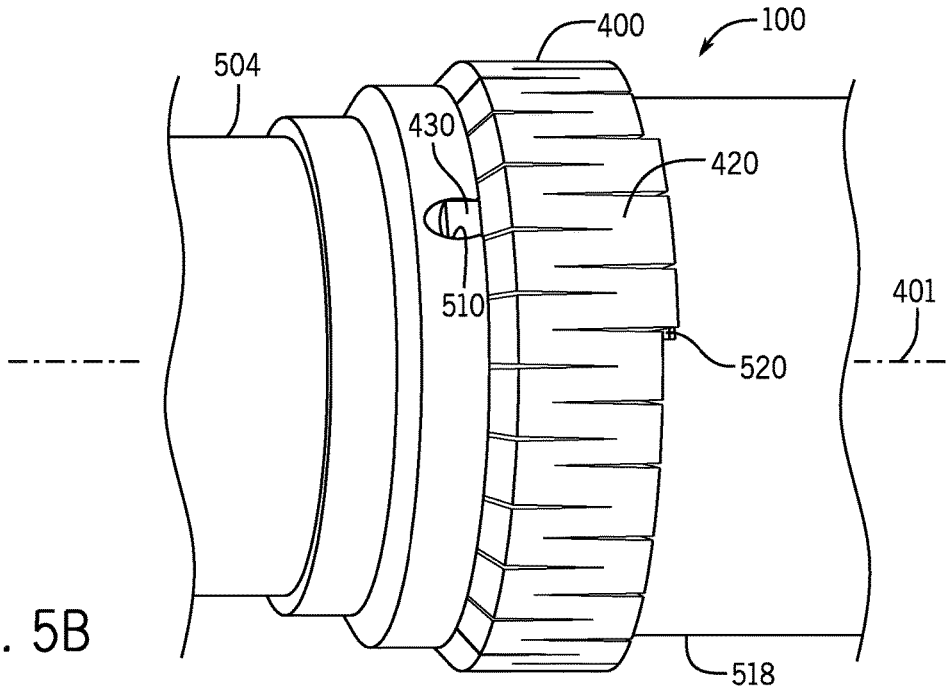

FIGS. 5A and 5B depict expansion of the metal sealing device 400 when used on the dart 100, in accordance with example implementations. In particular, FIG. 5A depicts the metal sealing device 400 in its radially contracted state, and FIG. 5B depicts the metal sealing device 400 in its radially expanded state. Referring to FIG. 5A in conjunction with FIG. 4A, in accordance with example implementations, the dart 100 has an anvil 518 that has a conical surface 550 circumscribes the longitudinal axis 401 of the metal sealing device 400. For the radially retracted state of the metal sealing device 400, the smaller outer diameter portion of the conical surface 550 extends into the interior of the metal sealing device 400 from the high pressure side 408 of the device 400, and the larger outer diameter portion of the conical surface 550 remains outside of the interior of the metal sealing device 400, as depicted in FIG. 5A. On its low pressure side 410, engagement tabs 430 of the metal sealing device 400 extend into corresponding recesses 510 on an actuating member 504 of the dart 100 to prevent the metal sealing device 400 from rotating about the axis 401.

Referring to FIG. 5B in conjunction with FIG. 4A, to radially expand the metal sealing device 400, the actuator of the dart moves the actuating member 504 to push the metal sealing device 400 farther onto the conical surface 550 so that the larger outer diameter portion of the surface 550 radially expands the device 400. As depicted in FIG. 5B engagement tabs 420 on the high pressure side 414 of the metal sealing device 400 are received in corresponding recesses 520 of the anvil 518.

Figure 6A:
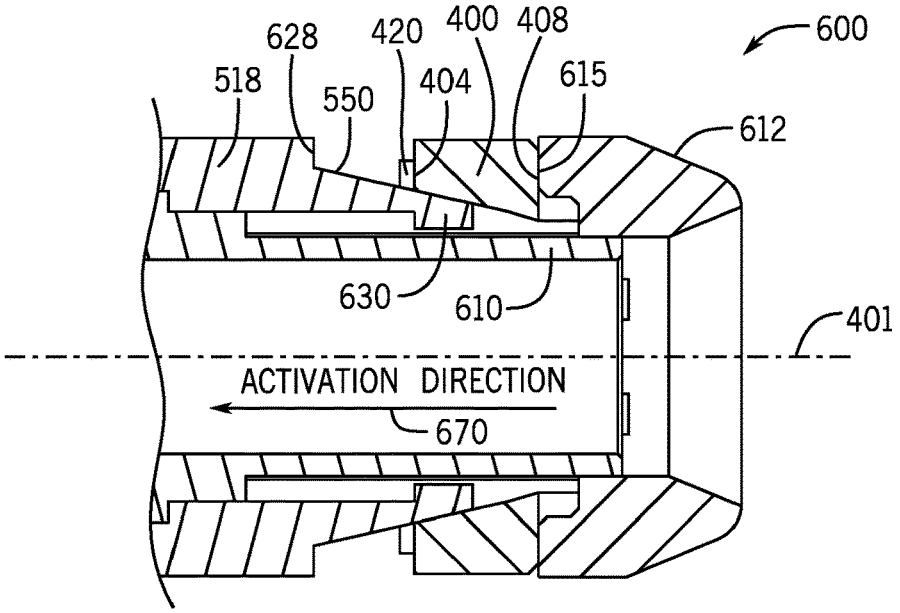
FIGS. 6A and 6B are cross-sectional views of a dart illustrating radial expansion of a metal sealing device of the dart according to a further example implementation.
Figure 6B:
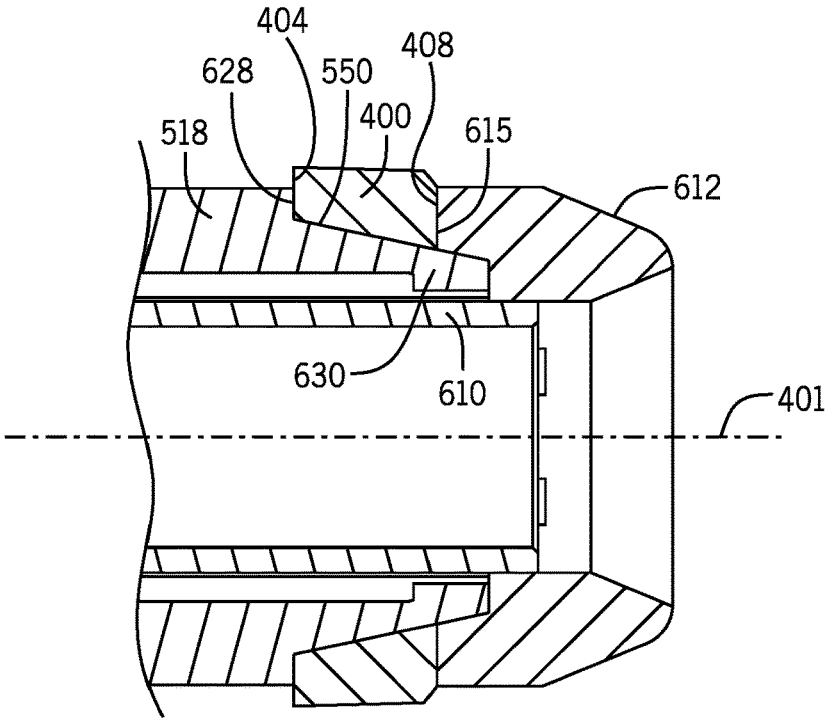

FIGS. 6A and 6B depict cross-sectional views of a dart 600 that has the metal sealing device 400, in accordance with further example implementations. FIG. 6A depicts the metal sealing device 400 in its radially contracted state, and FIG. 6B depicts the metal sealing device 400 in its radially expanded state. Similar reference numerals are used in FIGS. 6A and 6B to depict similar components that are described above, with other reference numerals being used to denote new/different components.

Referring to FIG. 6A, the dart 600 includes an actuating member assembly to move the metal sealing device 400 upon the conical surface 550 of the anvil 518 to radially expand the device 400. The actuating member assembly includes a bullnose-shaped ring 612 and an operator mandrel 610. The ring 612 may form the front end (the end leading into the well) of the dart 600, and the ring 612 has an annularly extending shoulder 615 that abuts the low pressure side 408 of the metal sealing device 400, in accordance with example implementations. The ring circumscribes the longitudinal axis 401 and is attached to one end of the mandrel 610. The mandrel 610 circumscribes the longitudinal axis 401.

When the metal sealing device 400 is be radially expanded, an actuator (not shown) of the dart 600 move the mandrel 610 in an activation direction 670 to move the metal sealing device 400 upon the larger outer diameter portion of the conical surface 550. As depicted in FIG. 6B, the axial translational movement of the operator mandrel 610 and the metal sealing device 400 ends when the ring 612 abuts a far end stop 630 of the anvil 518. At this point, the metal sealing ring 400 is axially compressed between the shoulder 615 of the ring 612 and an annularly extending shoulder 628 of the anvil 518.

Figure 7:
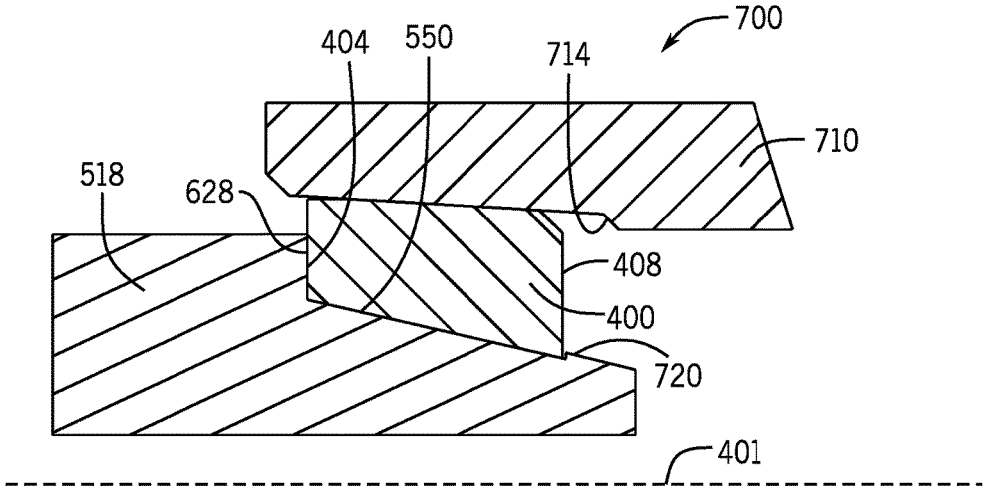
FIG. 7 is a partial cross-sectional view illustrating the metal sealing device being caught by a downhole seat according to an example implementation.

FIG. 7 is an illustration of a resulting fluid seal (i.e., fluid barrier) that is formed between the dart 600 and a downhole seat 714, in accordance with example implementations. It is noted that FIG. 7 merely depicts a partial cross-sectional view of the anvil 518 of the dart 600 and the seat 700 about the longitudinal axis 401, as one of ordinary skill in the art would understand that the full cross-sectional view would contain a mirrored image about the axis 401. As depicted in FIG. 7, the seat 714 may be formed in a downhole member 710, such as a member of a tool, seat assembly, and so forth. As also depicted in FIG. 7, the metal sealing device 400 may, in its final, radially expanded position, may reside in a recessed area 720 of the conical surface 720 for purposes of locking the sealing device 400 in its set position.

As noted above, depending on the particular implementation, the metal sealing device 400 may or may not be retractable. For implementations in which the metal sealing device 400 is not retractable, the dart may be removed using a milling operation. In further example implementations, one or more components of the dart, such as the metal sealing ring 400 may be constructed from a degradable material to allow removal of the device 400. In this manner, the meal sealing ring 400 and/or one or more parts of the dart (or other untethered object) may be constructed from dissolving, or degradable, materials that have sufficiently fast dissolution rates. In this manner, the dissolution rates allow removal of the fluid barrier in a relatively short time frame, such as a time frame of several days or several weeks, so that the well passageway is cleared for additional operations. The parts may be, for example, metallic parts that are constructed from dissolvable alloys, and the dissolution rates of the parts may depend on the formulation of the alloys. As an example, dissolvable, or degradable, alloys may be used similar to the alloys that are disclosed in the following patents, which have an assignee in common with the present application and are hereby incorporated by reference: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

Other implementations are contemplated, which are within the scope of the appended claims. For example, in accordance with further example implementations, a metal sealing device may be used with a downhole tool other than an untethered object to form a downhole fluid seal or fluid barrier in a well. In this manner, the metal sealing device may be used with a conveyance line-tethered device, such as a measurement tool, perforating gun, valve, and so forth, as can be appreciated by one of ordinary skill in the art. As another example, the metal sealing device may be used to seal downhole completion equipment. As another example, the metal sealing device may be used outside of the oil and gas industry, where relatively low leak rates are acceptable.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

deploying an untethered object through a passageway of a string in a well to cause the untethered object to travel along the passageway; and operating the untethered object as the object travels in the passageway to expand a metal sealing device of the untethered object to cause the object to become caught at a downhole location, wherein the metal sealing device is an expandable slotted ring comprising a plurality of axially extending beams, and wherein each beam of the plurality of axially extending beams remains in an elastic state during enlargement.

2. The method of claim 1, wherein operating the untethered object comprises extending an expansion member inside the metal sealing device to transition the metal sealing device from a first outer diameter to a larger second outer diameter.

3. The method of claim 1, wherein operating the untethered object comprises autonomously operating the untethered object in response to sensing a property of an environment of the string as the object travels through the passageway.

4. The method of claim 1, wherein operating the untethered object comprises communicating with the untethered object from an Earth surface of the well.

5. The method of claim 1, wherein operating the untethered object comprises operating the untethered object in response to sensing at least one marker in the well.

6. The method of claim 1, wherein operating the untethered object comprises sensing a repeating pattern as the object travels along the passageway.

7. The method of claim 1, wherein deploying the untethered object comprises pushing the object with fluid.

8. The method of claim 1, wherein operating the untethered object comprises operating the object to perform a downhole operation selected from the group consisting essentially of performing a stimulation operation, operating a downhole tool and operating a downhole valve.

9. The method of claim 1, further comprising causing the untethered object to travel through a plurality of seats and subsequently causing the metal sealing device to expand to cause the untethered object to be caught by another seat.

10. The method of claim 1, wherein operating the untethered object comprises at least one of the following:

shifting a sleeve;

forming a downhole obstruction; and operating a well tool.

11. A system usable with a well, comprising:

a string comprising a passageway; and an untethered object adapted to be deployed in the passageway such that the object travels in the passageway, the object comprising:

a metal sealing device;

an actuator; and a controller to operate the actuator to selectively radially expand the metal sealing device as the untethered object travels in the passageway, wherein the metal sealing device is an expandable slotted ring comprising a plurality of axially extending beams, and wherein each beam of the plurality of axially extending beams remains in an elastic state during enlargement.

12. The system of claim 11, wherein the string comprises a plurality of seats, each of the seats being sized to catch an object having substantially the same size, and the untethered object is adapted to pass through at least one of the seats and controllably expand to said same size to cause capture of the untethered by one of the seats.

13. The system of claim 11, wherein the metal sealing device comprises:

a first pressure receiving side to circumscribe an axis of the sealing device;

a second pressure receiving side to circumscribe the axis;

first axially-extending slots in the first pressure receiving side; and second axially-extending slots in the second pressure receiving side, the second axially-extending slots being offset from the first axially-extending slots to form axially-extending beams.

14. The system of claim 13, wherein the actuator comprises a tapered expansion member to extend inside the metal sealing device to transition the metal sealing device downhole in the well from a first outer diameter to a larger second outer diameter.

* * * * *